US007293734B1

(12) United States Patent
Kantner

(10) Patent No.: US 7,293,734 B1
(45) Date of Patent: Nov. 13, 2007

(54) APPARATUS FOR STORING AND DISPENSING PLIABLE, ELONGATED ARTICLES

(76) Inventor: Robert C Kantner, 9 Woodcrest Ct., Newark, DE (US) 19702

( * ) Notice: Subject to any disclaimer, the term of this patent is extended or adjusted under 35 U.S.C. 154(b) by 362 days.

(21) Appl. No.: 11/173,501

(22) Filed: Jun. 30, 2005

(51) Int. Cl.
*B65H 75/30* (2006.01)

(52) U.S. Cl. ..... 242/395.1; 242/400; 242/405; 242/405.3; 242/406; 242/588.6

(58) Field of Classification Search ..... 242/129, 242/139, 388, 388.5, 395, 395.1, 400, 405, 242/405.3, 406, 588.6; 191/12.2 R
See application file for complete search history.

(56) References Cited

U.S. PATENT DOCUMENTS

| | | | | |
|---|---|---|---|---|
| 2,801,303 | A | 7/1957 | Pailing | |
| 2,871,057 | A * | 1/1959 | Bernyk | 242/129 |
| 3,313,498 | A | 4/1967 | Wasson | |
| 4,132,367 | A | 1/1979 | Ineson et al. | |
| 5,344,094 | A | 9/1994 | Hoffman | |
| 5,915,641 | A | 6/1999 | Barberg | |
| 6,056,226 | A | 5/2000 | Green | |
| 6,186,433 | B1 | 2/2001 | Kovacik et al. | |
| 6,557,792 | B1 | 5/2003 | Snow | |
| 6,807,982 | B1 * | 10/2004 | Ames | |

OTHER PUBLICATIONS

"Wonder Winder", Catalog #35-257, Gardener's Supply Catalog, www.gardeners.com.

* cited by examiner

*Primary Examiner*—William A. Rivera
(74) *Attorney, Agent, or Firm*—Law Office of Jeffrey R. Ramberg

(57) ABSTRACT

An apparatus for storing and dispensing pliable, elongated articles such as electrical cords or cables. The apparatus features a reel, an axle and a bucket, with the axle being co-axial with the reel and with the bucket. The reel is mounted on the axle in the bucket with minimal wobble, which makes for essentially no contact to the interior wall(s) of the bucket. The mounting also utilizes a low friction bearing, such as a line or near-line contact. The result is very little friction, which is especially significant when pulling the cord out of the bucket, as it helps prevent tipping or sliding of the apparatus when the apparatus has to provide its own stability. The apparatus may also feature one or more anti-tipping or anti-skidding devices.

20 Claims, 3 Drawing Sheets

APPARATUS FOR STORING AND DISPENSING PLIABLE, ELONGATED ARTICLES

BACKGROUND OF THE INVENTION

1. Field of the Invention

The instant invention relates to devices for conveniently storing and dispensing flexible, elongated articles such as hoses or electrical cords in a neat package and without introducing kinks or twists in the article, as in other techniques that involve winding of the article.

2. Discussion of Related Art

U.S. Pat. No. 2,801,303 to Grace N. Pailing discloses a cord reel for winding and storing the power cords of electrical appliances such as toasters and kitchen mixers, etc. The reel features a housing and a drum assembly. In operation, the plug end of an appliance cord is snaked through the apparatus and plugged into a receptacle. The drum is then rotated by means of a crank, with the housing being stationary. This winds the cord onto the drum. Mounting means such as holes are provided at select locations in the housing so that once the cord has been completely wound, the cord reel apparatus can be attached to the appliance, such as by means of hooks or other protrusions on the appliance that can engage the holes in the housing.

U.S. Pat. No. 3,313,498 to Lawrence W. Wasson discloses a wire dispensing reel particularly useful for dispensing the wire ties that masonry workers use to temporarily hold sections of re-bar together until the concrete can be poured around them and rigidified. The walls that make up the sides of the shaft-mounted reel are expandable to accommodate varying amounts of the wire tie material, and are biased toward each other by springs.

U.S. Pat. No. 4,132,367, to Norman Ineson et al, assigned to Indicel Co., Ltd. discloses a cord winder that features a number of planetary drums that orbit about a fixed sun drum when driven by a crank or spring motor. The orbiting planetary drums layer the cord neatly onto the sun drum.

U.S. Pat. No. 5,344,094 to Julius Hoffman discloses an apparatus for coiling and retaining a coiled article such as electrical wire. The apparatus features a disc-shaped base with a platform that is rotatably mounted on it using a low friction bearing (i.e., a Lazy Susan arrangement). A post extends coaxially upward from the platform, and has periodic notches along its height. An upper plate is slidably mounted along the post, with a means for locking the plate into any one of the notches. The platform and upper plate feature inward tapers to help keep the coiled article close to the post. The apparatus also features a braking mechanism, a hole in the upper plate for "tying off" the loose end of the coiled article, and a retractable handle to assist a person in carrying the apparatus.

U.S. Pat. No. 5,915,641 to Daniel A. Barberg, and assigned to Reel-a-Pail, Inc. discloses a system for storing and dispensing "flexible elongate members", e.g., a power cord. The system features a bucket with an elongated hole in the side. Mounted coaxially inside the bucket is a tube attached to bottom and top discs to form a reel. The cord is wound around the tube between the two discs. The top disc has a hole so one end of the cord can exit out the top of the system. The other end of the cord exits through the side opening of the bucket. The reel is mounted on a bearing assembly such as a "Lazy Susan". A winder/unwinder mechanism such as a crank or knob is attached to the top discs to permit rotation of the reel. A flat plate is attached to the bottom of the bucket so that, in the field, the user can hold the bucket in place with his foot while he cranks on the winder/unwinder mechanism. The flat plate also features a number of holes so that the system can be mounted on a fixed surface, such as a wall of a garage. A number of small notches or grooves are placed along the top rim of the bucket so that, when the cord is being used in the field, one end of the cord can be pressed into a notch, thereby taking that end of the cord off of the ground so that it is not run over, stepped on or damaged. The outside wall of the bucket may feature a ridge or shoulder to support a belt or strap, for example, for carrying the system. The bucket may feature a handle for easier portability. Tools may be stored in the center of the tube, which may be compartmentalized for greater organization. Instead of a crank or knob, a nut or other receptacle for receiving a nut driver may be coaxially mounted to the top disc so that a nut driver may do the winding/unwinding. In an alternate embodiment, an electrical bearing assembly permits the flow of electrical power from a stationary member to a rotating member, thereby eliminating the spinning or twisting of one end of the cord while the other end is being let in or taken out of the bucket.

The reel assembly of the Barberg invention is held in place by gravity, but is otherwise free to be removed from the bucket.

U.S. Pat. No. 6,056,226 to Robert L. Green discloses a caddy for electrical cords that appears similar to the Barberg invention. The Green system features a reel upon which is wound a heavy-duty electrical extension cord. The reel is coaxially mounted on a bearing assembly such as a Lazy Susan inside a container such as a bucket. The reel features a base plate, a cylindrical support upon which the cord is wound, and a cylindrical shaft that is mounted inside the support and concentric with its axis. The bucket or other cylindrically shaped container has a handle for ease in manually transporting the caddy. There is a hole in the side of the bucket and another hole in the side of the cylindrical support so that the cord enters the side of the bucket, is wound on the support, and exits the caddy by passing into the inside of the support and then turning and going out the top. The reel is rotated by means of a detachable crank that features a quick disconnect coupling which mates with a second disconnect member that is secured to the cylindrical shaft. The system also features a cover for the open (top) end of the bucket, the cover having a hole in its center through which the shaft and disconnect member pass when the cover is in place on the bucket. In operation, the cord is simply pulled out from the reel until the desired amount has been pulled out. Then the cover and crank are removed, and the other end of the cord is pulled out of its storage area in the inside of the cylindrical support and plugged into an electrical outlet. To store the extended cord, the outlet end of the cord is unplugged from the outlet and stored in the hollow space within the cylindrical support. The cover and crank are then re-installed, and the crank is rotated to take up the cord onto the support.

U.S. Pat. No. 6,186,433 to James D. Kovacik et al., assigned to Alert Stamping and Mfg. Co., Inc. discloses a manually wound cord storage unit featuring a spool that is rotatably mounted on a hub. A frame is attached to the hub, and a handle and a plurality of feet are attached to the frame. The handle is for ease of transportation, and the feet are to hold the cord off of the ground (which could be wet, muddy, etc.) when the storage unit is used in the field. A knob or crank is attached to the spool. The cord is stored on the spool, in particular, by winding it around the hub. To wind or unwind cord, the operator holds the frame in one hand, and cranks the knob around the axis of the hub with the other hand.

U.S. Pat. No. 6,557,792 to Mark Snow discloses an apparatus for storing and dispensing holiday light strings, particularly of the "icicle" variety that feature a plurality of short light segments that hang down orthogonal to the main line. The apparatus features a vertical spindle, generally tapered, legs to support the spindle in a vertical orientation while the apparatus is resting on the ground, and a bearing assembly for easy rotation of the spindle. A removable or retractable crank can be mounted on the top of the spindle to assist in winding the lights back on the spindle. The apparatus can also have a plurality of protrusions ("bumps") arranged on the outer surface of the spindle to help hold the light string in place and prevent it from sagging or drooping when it is wound on the spindle. The apparatus may also feature a skirt at the base of the spindle to prevent the light string from becoming tangled in the support legs of the apparatus.

SUMMARY OF THE INVENTION

It is an object of the instant invention to store an elongated element such as a power cord, audio/video cables, etc.

It is an object of the instant invention to be able to dispense a desired length of the elongated element.

It is an object of the instant invention to be able to quickly and conveniently bring the dispensed elongated element back into a stored condition.

It is an object of the instant invention to wind the dispensed length of elongated element in a coiled condition without introducing twists in the elongated element.

These and other objects of the invention that will become apparent to the skilled artisan upon reading the instant disclosure are accomplished by providing a cord storage and dispensing apparatus that features a reel, an axle and a bucket, with the axle being co-axial with the reel and with the bucket. In other words, the reel is mounted on the axle in the bucket with minimal wobble, essentially no contact to the interior wall(s) of the bucket, and utilizing a low friction bearing, such as a point or near-point contact. The cord is then wound on the reel, with one end of the cord extending out of a hole in the side of the bucket, and the other end extending up out of the open top end of the bucket. The invention has an anti-slipping or anti-tipping feature, but generally does not feature a lid or cover for the apparatus.

DETAILED DESCRIPTION OF THE INVENTION AND PREFERRED EMBODIMENTS

The instant invention is an apparatus for conveniently storing and dispensing a coiled element such as an electrical power cord. The essence of the instant apparatus is a reel, an axle and a bucket, with the axle being co-axial with the reel and with the bucket. In other words, the reel is mounted on the axle in the bucket. The cord is then wound on the reel, with one end of the cord extending out of a hole in the side of the bucket, and the other end extending up out of the open top end of the bucket.

Figure 1:
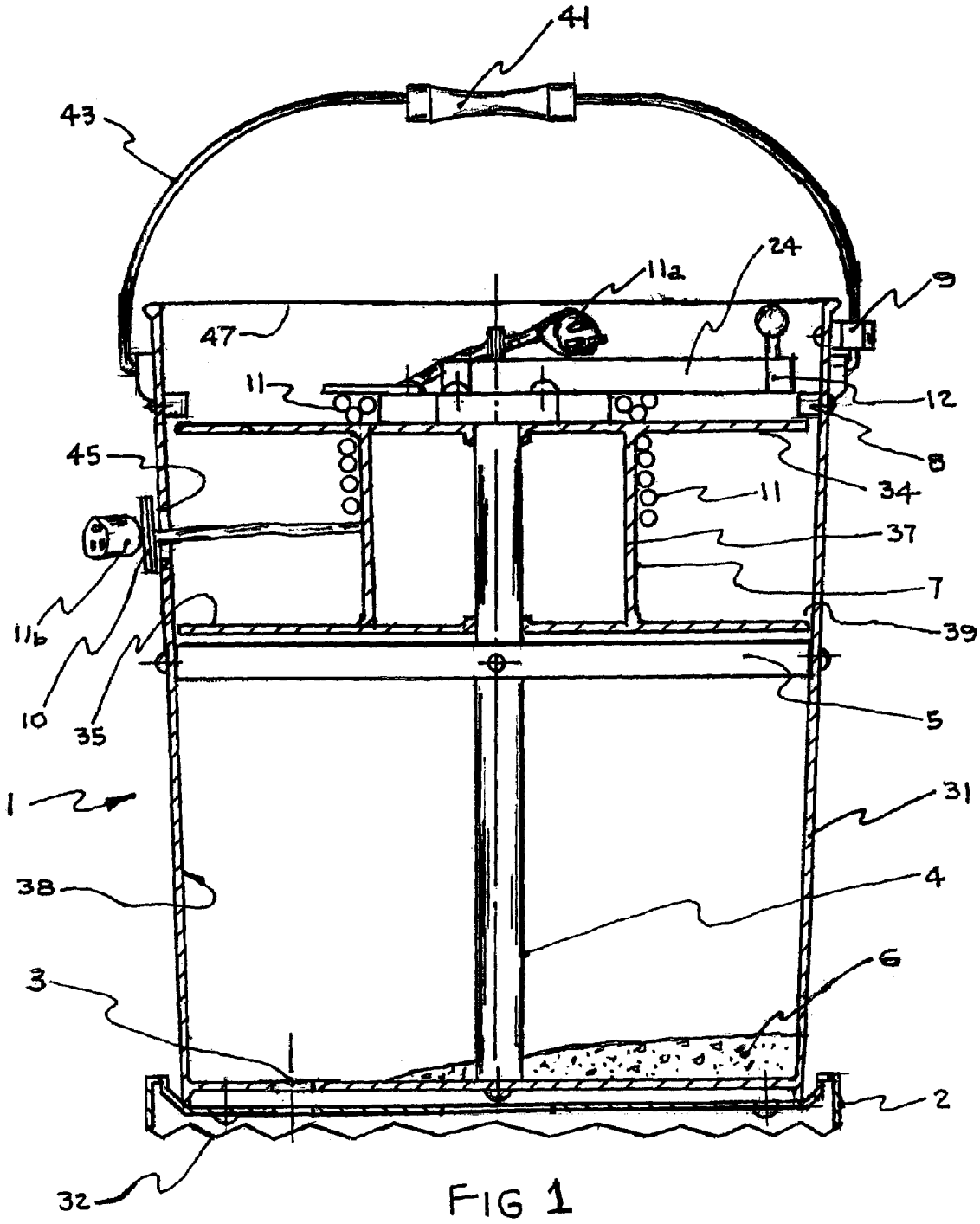
FIG. 1 is a cross-sectional side view of apparatus.
Figure 2:
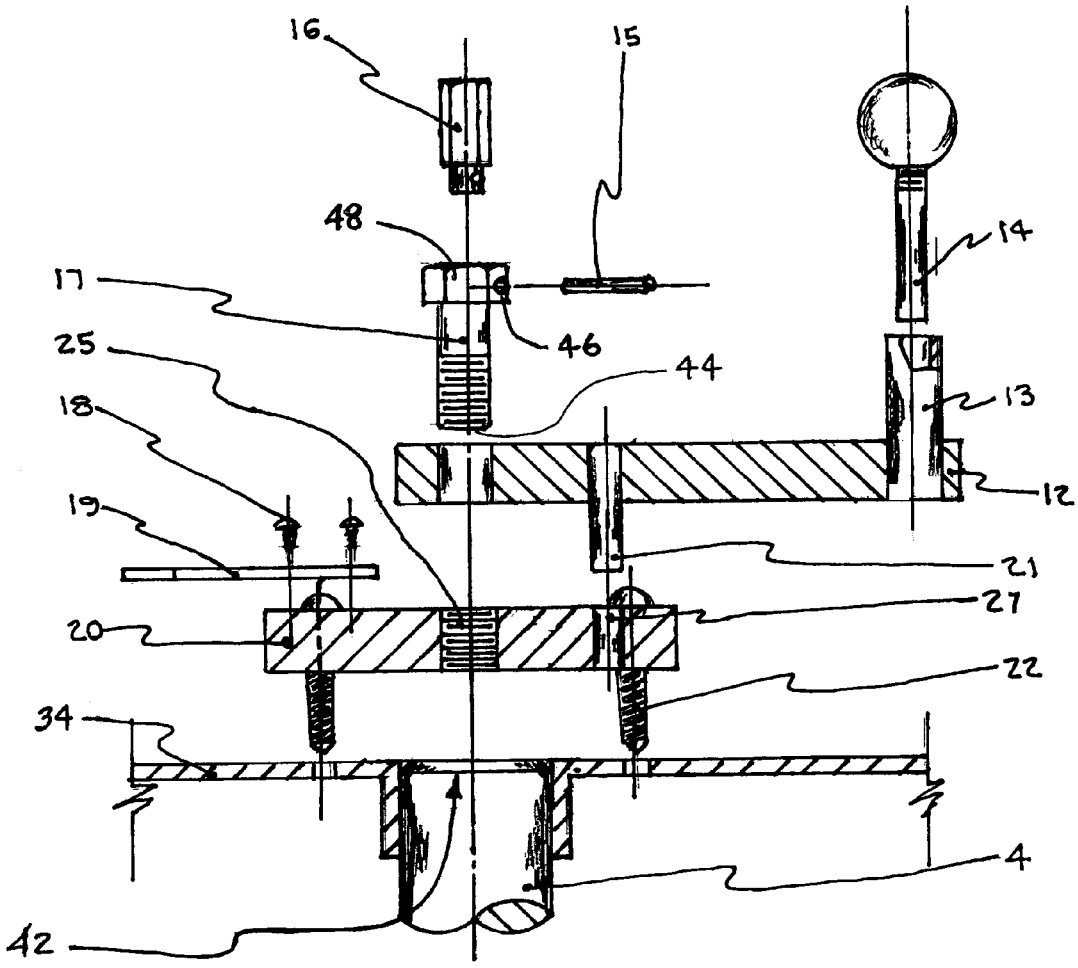
FIG. 2 is a side view in exploded form, of the winding mechanism of the instant invention.
Figure 3:
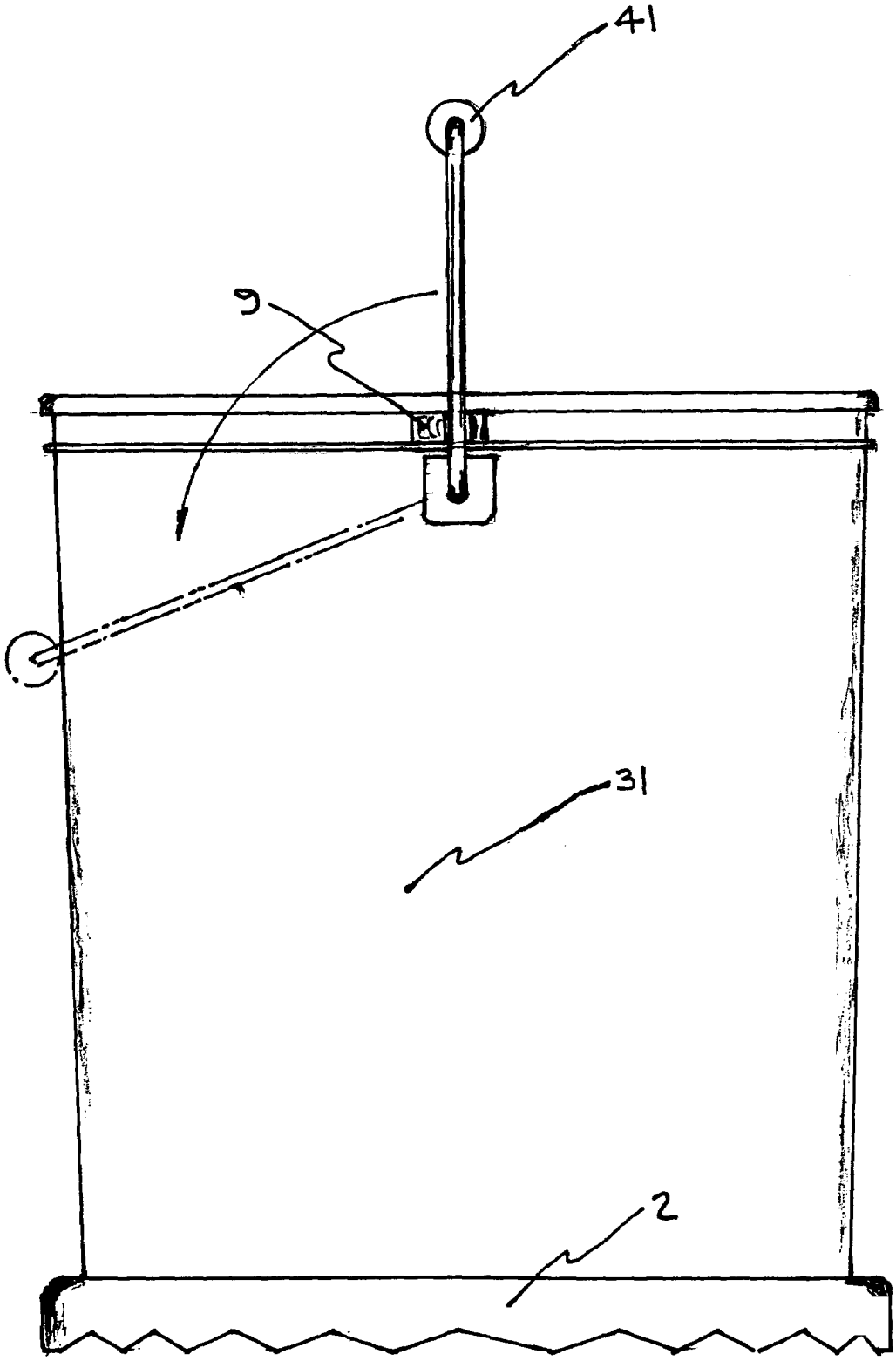
FIG. 3 is a side view of the apparatus showing the handle in the two different positions.

FIGS. 1-3 illustrate with greater specificity preferred embodiments of the invention.

Referring to FIG. 1, bucket 1 is seen to generally be tube-shaped, and closed on the bottom end and open on the top end. The walls 31 generally are vertical, or orthogonal to the bottom surface, but they can be tapered somewhat without defeating the essence of the invention. A horizontal cross-section of the walls of the bucket as shown defines a circle, but it may be any regular polygon. In other words, each wall is the same distance from a locus, thereby defining an axis. The axle 4 of the present invention is attached to one or both of the reel and the bucket, and is co-axial with this axis. In a preferred embodiment, the apparatus may feature one or more members 5 that attach to the axle and extend out to the inner wall of the bucket and are attached there, thereby centering and stabilizing the axle.

The bucket may also contain a stabilizing feature. In one embodiment, this feature can be an anti-tipping feature that takes the form of a weight 6 at or near the bottom of the bucket, thereby moving the center of gravity of the apparatus closer to the base of the bucket, thereby stabilizing the bucket. The weight may be uniformly or non-uniformly distributed along and around the base of the bucket. One example of a non-uniformly distributed weight has the bulk of the weight located opposite the hole 45 in the side of the bucket. If the weight has a grade, rise or slope to it, this can assist water or other liquids that enter the interior of the bucket to run toward a drain hole 3. In another embodiment, the bucket may feature a component 2 attached to the bottom of the base that may or may not necessarily provide better stability to the bucket, but does provide enhanced friction, particularly on grass or dirt. In this way, the pliable, elongated article can be pulled from the reel without having to hold or steady the apparatus with the other hand or with a foot. The enhanced friction of this anti-slipping feature may be provided by a plurality of "teeth" or serrations 32 cut along or around the edge of the component attached to the base. In a preferred embodiment, the component attached to the base resembles a lid that might have originally been sold as part of the bucket, but is now not intended as a lid but rather as a base for the bucket. The bucket may embody both kinds of stability features.

The reel 7 is the component of the apparatus on which the cord 11 is wound. The reel features a pair of generally flat surfaces or "flanges" 34, 35 parallel to one another and separated at a fixed distance by a hub 37. The inside surface of the hub defines an inside diameter that fits over the axle. The flanges may be any regular polygon shape but preferably are circular. The reel attaches or is mounted on the axle such that the axle is co-linear with the hub and with the axis of the polygons that make up the flanges of the reel. In other words, the axle is normal to the flanges of the reel. The reel features an opening (not shown) through its upper surface to permit passage of the cord out of the apparatus.

Many of the cord storage/dispensing apparati of the prior art feature "Lazy Susan" type of bearing assemblies beneath the rotating component that holds the cord. This type of bearing assembly generally is a circular disc that is able to rotate freely within its plane by virtue of a circular bearing race containing a plurality of ball bearings. In contrast, the instant invention utilizes a bearing that is a line or near-line contact, or at least a very small surface contact, and in one embodiment is very nearly a point contact. This type of bearing is very simple, and has been found to be entirely satisfactory for the application. The bearing is generally located within the reel assembly, co-linear with the axis of the hub, and preferably located closer to the top surface of the reel than the bottom surface. In an alternate embodiment, the bearing surface is located slightly above the top surface of the reel assembly, but still generally collinear with the axle. In particular, the hub is designed such that it is just slightly larger than the axle. The bearing surface is located at the spot where the reel (or a component of the apparatus that is attached to the reel) contacts the top surface of the axle. This surface is generally shaped such that the engagement occurs at a point or a short line or at least on a very small area. The friction then during rotation of the reel is very small. Preferably, at least one of the contacting surfaces is formed of a hard material. Further, by making the inside diameter of the hub only slightly larger than the axle, the "wobble" of the reel on the axle is minimal, and the outer edges 39 of the flanges of the reel can be prevented from contacting the inner wall 38 of the bucket. Such contact can lead to deleterious friction. The axle is of such a length, and the low friction contact surface at or near the top of the reel assembly is designed such that the reel is not in contact with the base of the bucket nor with the axle-stabilizing member 5, but rather "floats" slightly above it.

Once the apparatus is assembled, the reel does not normally detach, but rather remains mounted on the axle within the bucket. This may be accomplished with one or more "stops" 8.

In a preferred embodiment, the apparatus features a winder assembly 24 that attaches to the reel, preferably at the hub of the reel and co-linear with the axis of the reel. The arm 12 of the winder assembly may be mounted below the upper edge 47 of the bucket 1 so that the apparatus is more readily stackable. If the arm extends above the upper edge of the bucket, for example, then preferably it is removable such that stackability is restored.

Referring to the winder assembly in more detail in FIG. 2, mounting plate 20 is attached to upper flange 34 of reel assembly 7 by means of mounting screws 22. Mounting plate 20 features an on-axis threaded hole 25 arranged to engage bolt 17, and also features an off-axis hole 27 arranged to engage pin 21. Arm 12 features three holes to accommodate bolt 17, pin 21 and bushing 13, the latter two of which are press fit or otherwise attached firmly to the winder. Arm handle 14 is rotatably mounted in bushing 13, and may be freely removable or may be fixed in place, for example, by means of a nut. A shaft or nut designed to engage with a drill, nut driver or power screwdriver may be mounted concentric with the axle above the reel so that a power tool such as one of the above-mentioned may be used to wind up the cord on the reel. In FIG. 2, since bolt 17 is co-axial, hexagonal shaft 16 is depicted as co-linear with bolt 17 and is fastened to bolt 17 by means of pin 15, which may be press fit into position through hole 46 and cavity 48 in bolt 17. Arm 12 then is attached to mounting plate 20 by means of bolt 17, with pin 21 fitting into hole 27.

If the hub 37 of reel assembly 7 has a top surface 42, then contact of this surface with the top of the axle 4 may constitute the low friction, low-area-contact bearing surface. If hub 37 is "open" at the top, then the bearing surface may be formed by the contact of the top of the axle 4 with the bottom surface 44 of bolt 17.

Normally, the end of the cord that extends out of the top of the reel and out of the top of the bucket will be the male end that plugs into the power source, e.g., electrical receptacle. Regardless of which end it is, it may be desirable that at least about 4 feet of cord extend out the top. During winding and unwinding, it is best that this section of cord not be extended yet, but instead be housed in the apparatus until winding/unwinding is complete. Accordingly, a plurality of tabs 19 may be mounted, for example using fasteners 18, above the reel assembly to form a small region above the reel where the short section of cord may be wound to temporarily secure it. The tabs hold the cord in place and prevent it from unwinding or tangling. In the embodiment in which the winder apparatus is mounted low so that it resides completely within the bucket, the arm 12 itself may doubly serve as a "tab substitute" for one of the tabs in helping to hold the male plug end of the cord in place.

In a preferred embodiment, the apparatus contains a handle 41 for assistance in carrying the apparatus, thereby enhancing portability. The handle may be of a kind normally associated with buckets; that is, a stiff wire 43 bent in an arc, with each end attached to the bucket, preferably near the top edge. In this way, and referring now to FIG. 3, the handle may be rotated to an upright position for carrying the apparatus, and rotated in a downward position, perhaps resting against the side of the bucket, at other times. The carrying fixture may further feature one or two detents 9 that may serve to hold the handle in the upright position.

The apparatus normally will not have a cover or lid. Detachable components may become lost, particularly on a construction site where the apparatus may be moved around a lot, and where there are lots of tools, materials and debris lying around. Some prior art devices have such a covering for the top, open end of the bucket, possibly on the theory that the interior of the bucket needs to be protected from rain, etc. In contrast, the instant invention is not troubled by the insides of the bucket getting wet. In fact, it is an object of the instant invention to be able to clean the interior of the bucket with clean water such as from a pressurized hose. To this end, one or more drain holes 3 are placed at or near the bottom of the bucket. The drain holes communicate with the space beneath the bottom wall of the reel assembly. If there is insufficient space between the reel flanges 34, 35 and the inner wall of the bucket for prompt drainage, one or more drain holes may also be placed in the bottom flange 35. If a sloped weight is employed as a stabilizing feature, at least one drain hole should be located at the lowest point of the weight.

The opening 45 in the side of the bucket through which the cord is extended and retracted may vary in size, but of course must be large enough to pass the uniform diameter of the cord. Normally, the opening will be sufficiently large to pass the ends 11*a*, 11*b* of the cord 11 as well, so that cords may be interchanged on the reel without having to disassemble the apparatus to remove the reel assembly. In a particularly preferred embodiment, however, the size of the opening is just barely large enough to pass the end of the cord, and generally only when the plug is orthogonal to the opening. In this way, when the cord is being retracted, the plug is typically not exactly orthogonal to the opening, and typically the end will catch on the wall of the bucket and will not be pulled through the opening.

In another preferred embodiment, the opening can contain a wiper feature 10 such as a flexible material such as rubber, plastic, cloth or fabric that can serve to wipe debris or liquid from the surface of the cord as it is being reeled into the bucket. The wiper feature may be attached to the bucket, for example, surrounding the hole on the outside side wall. Alternatively, it may be loosely attached to the cord between the outside wall and the end of the cord that lies outside of the bucket.

Operation of the Apparatus

Using the power cord embodiment as an example, the operation of the apparatus is as follows.

With the apparatus fully assembled, the cord is wound onto the spool/reel as follows. The male end of the power cord is inserted through the hole in the side of the bucket and passed up through the hole in the top polygon of the reel assembly. About 8 feet of cord is extended out of the top surface of the apparatus. These 8 feet of cord are then wound on the retainer tabs on the outside top of the reel assembly. The reel assembly is then rotated, whether using the crank or winder apparatus that is attached to the shaft of the reel assembly, or by means of a power tool such as a nut driver or drill engaging the hexagonal shaft at the top of the axle. As the reel assembly winds, the cord is drawn into the bucket through the hole in the side of the bucket, winds around the hub, and in general is taken up on the reel assembly.

If the wound cord needs to be cleansed, this may be accomplished by spraying water into the bucket either through the side hole, or from above the reel assembly, or both. The excess water drains through the reel assembly and cord contained therein to the region beneath the reel assembly, and finally out the one or more drain holes near the bottom of the bucket.

To dispense cord, the user merely pulls on the end of the cord that extends out of the side of the bucket, which would normally be the female end of the cord. Because of the low friction design, the cord comes out quite easily, and in fact the apparatus may simply be placed on the ground or floor, and the friction with the ground or floor by itself is generally sufficient to prevent the apparatus from moving while the cord is being pulled out. The weight at the base of the apparatus also helps to keep the apparatus from sliding or tipping while the cord is being withdrawn, even without the operator or a helper holding the apparatus in place. Thus, the operator does not have to remain near the apparatus. He or she may place it on the floor or ground close by the electrical outlet, grab the female end of the cord, and walk with this end over to the spot where the power is needed. The other (male) end of the cord is then unwound from the guide tabs to the extent needed to connect to the electrical outlet.

INDUSTRIAL APPLICABILITY

The instant storage and dispensing apparatus will find application in the construction and demolition industries, as well as the movie, television and radio production industries, to name a few. Utility companies, too, are big users of cords or cables for power and electronics, e.g., communications. The instant apparatus will also be of use to homeowners and others who care for and maintain dwelling places, such as plumbers, electricians, and carpenters. It will find utility in businesses large and small, particularly in those firms' maintenance departments. The instant device could be used to store and dispense hoses such as a common garden hose, or larger hoses such as those used by firefighters.

In the construction industry in particular, the instant device can store and dispense a 100-foot length of power cord easily and quickly with minimal friction and effort. The apparatus is durable and made of corrosion resistant materials such as plastic, thereby enabling the device and contents to be washed with water, such as warm soapy water. The drain holes permit the device to air dry, drip dry without having to disassemble and individually dry the components of the device.

An artisan of ordinary skill will readily appreciate that numerous minor modifications may be made to the invention just described without deviating from the scope of the invention, as defined literally by the claims appended hereto.

I claim:

1. An apparatus for neatly storing and dispensing an elongated element, comprising:

(a) a reel assembly comprising a hub and a pair of parallel and opposing polygons, each having an axis, with the axis of the hub being co-linear with the axes of the polygons, the opposing polygons being identified as upper and lower, respectively, with the upper polygon featuring at least one hole sufficiently large to pass an end of the elongated element therethrough;

(b) a bucket whose horizontal cross-section defines a regular polygon, and comprising a base and at least one wall attached to the base and defining an edge of the at least one polygon, the at least one wall containing at least one hole therethrough, the hole being sufficiently large to pass an end of the elongated element therethrough, the bucket further more comprising at least one weight located near the base, thereby moving the center of gravity of the apparatus closer to the base;

(c) an axle attached to the bucket such that it is co-linear with the axis of the bucket, the reel assembly being mounted on the axle such that the axle is co-linear with the hub of the reel assembly and such that is supports the reel assembly off of the bottom surface of the bucket, and wherein the axle or the surface of the hub in contact with the axle is made of a material that is harder than wood or plastic and which forms a point or near-point contact, thereby forming a low-friction bearing surface, and wherein the hub has an inner diameter than is only slightly larger than the axle diameter.

2. The apparatus of claim 1, wherein said at least one hole in said wall doubles as a water drain hole.

3. The apparatus of claim 1, further comprising a separate water drain hole located near the base of the bucket.

4. The apparatus of claim 1, further comprising at least one stop to hold the reel assembly within the bucket.

5. The apparatus of claim 1, further comprising a means for centering and stabilizing said axle.

6. The apparatus of claim 5, wherein said means comprises a cross-brace.

7. The apparatus of claim 1, further comprising a crank for rotating said reel assembly.

8. The apparatus of claim 1, further comprising a means for engaging a nut driver, screwdriver or drill.

9. The apparatus of claim 1, further comprising a plurality of tabs for holding a section of said elongated element in place above said reel assembly.

10. The apparatus of claim 9, wherein said crank doubles as one of said tabs.

11. The apparatus of claim 1, further comprising a handle for carrying said apparatus.

12. The apparatus of claim 11, wherein said handle can be rotated from a side or downward position to an upright position, and further comprising a detent to hold said handle in said upright position.

13. The apparatus of claim 1, not comprising a cover or lid to cover said top opening.

14. The apparatus of claim 1, wherein said side opening is just barely large enough to pass an end of said elongated article.

15. The apparatus of claim 1, further comprising a means for wiping moisture or debris off of said elongated article.

16. The apparatus of claim 15, wherein said means for wiping comprises an elastic material mounted circumferentially around said side hole.

17. The apparatus of claim 1, arranged to be stackable.

18. The apparatus of claim 1, wherein the weight is non-uniformly distributed around the circumference of the base such that the weight opposite the hole in the wall is greater than the weight nearest said hole.

19. An apparatus for neatly storing and dispensing an elongated element, comprising:

(a) a reel assembly comprising a hub and a pair of parallel and opposing polygons, each having an axis, with the axis of the hub being co-linear with the axes of the polygons, the opposing polygons being identified as upper and lower, respectively, with the upper polygon featuring at least one hole sufficiently large to pass an end of the elongated element therethrough;

(b) a bucket whose horizontal cross-section defines a regular polygon, and comprising a base and at least one wall attached to the base and defining an edge of the at least one polygon, the at least one wall containing at least one hole therethrough, the hole being sufficiently large to pass an end of the elongated element therethrough, (c) an axle attached to the bucket such that it is co-linear with the axis of the bucket, the reel assembly being mounted on the axle such that the axle is co-linear with the hub of the reel assembly and such that is supports the reel assembly off of the bottom surface of the bucket, and wherein the axle or the surface of the hub in contact with the axle is made of a material that is harder than wood or plastic and which forms a line or low surface area contact, thereby forming a low-friction bearing surface, and wherein the hub has an inner diameter than is only slightly larger than the axle diameter; and (d) a skid-resistant surface mounted to a bottom surface of said base of said bucket.

20. The apparatus of claim 19, wherein said skid-resistant surface features a plurality of serrations to contact the surface upon which the apparatus is placed.

* * * * *